US005305802A

United States Patent [19]

Fehrenbach

[11] Patent Number: 5,305,802

[45] Date of Patent: Apr. 26, 1994

[54] DRIVE ADJUSTMENT DEVICE FOR SECTIONAL WARP BEAM LET-OFF MOTION

[75] Inventor: Lutz Fehrenbach, Constance, Fed. Rep. of Germany

[73] Assignee: Gebrueder Sulzer Aktiengesellschaft, Winterthur, Switzerland

[21] Appl. No.: 32,345

[22] Filed: Mar. 16, 1993

[30] Foreign Application Priority Data

Mar. 27, 1992 [EP] European Pat. Off. ..... 92810226.8

[51] Int. Cl.[5] ..... D03D 49/06

[52] U.S. Cl. ..... 139/103; 139/110

[58] Field of Search ..... 139/103, 114, 110; 28/185; 73/160

[56] References Cited

U.S. PATENT DOCUMENTS

| | | | |
|---|---|---|---|
| 4,262,706 | 4/1981 | Popp et al. | 139/103 |
| 4,662,407 | 5/1987 | Duncan . | |
| 4,722,368 | 2/1988 | Pezzoli | 139/103 |

FOREIGN PATENT DOCUMENTS

| | | |
|---|---|---|
| 0109472 | 5/1984 | European Pat. Off. . |
| 0136389 | 4/1985 | European Pat. Off. . |
| 0208366 | 1/1987 | European Pat. Off. . |
| 0350446 | 2/1990 | European Pat. Off. . |
| 0407824 | 1/1991 | European Pat. Off. . |
| 2009260 | 6/1977 | United Kingdom . |

*Primary Examiner*—Andrew M. Falik

*Attorney, Agent, or Firm*—Townsend and Townsend Khourie and Crew

[57] ABSTRACT

The weaving machine has at least two sectional warp beams (20*a*, 20*b*) and at least one whip roll (23) rotatably mounted to the machine. Each sectional warp beam is equipped with an individually drivable warp let-off motion (30, 31, 32). Feeler members (13*a*, 13*b*) are mounted symmetrically on a rocker-like bar (10) to measure the warp yarn tension and control devices individually control the speed of rotation of the sectional warp beams. The rotational axis (11) of the bar (10) is parallel to the warp plane and is situated between the sectional warp beams. A sensor (14*a*) determines the deviation of the bar alignment from a reference position, so that it is possible to effect warp let-off control.

14 Claims, 3 Drawing Sheets

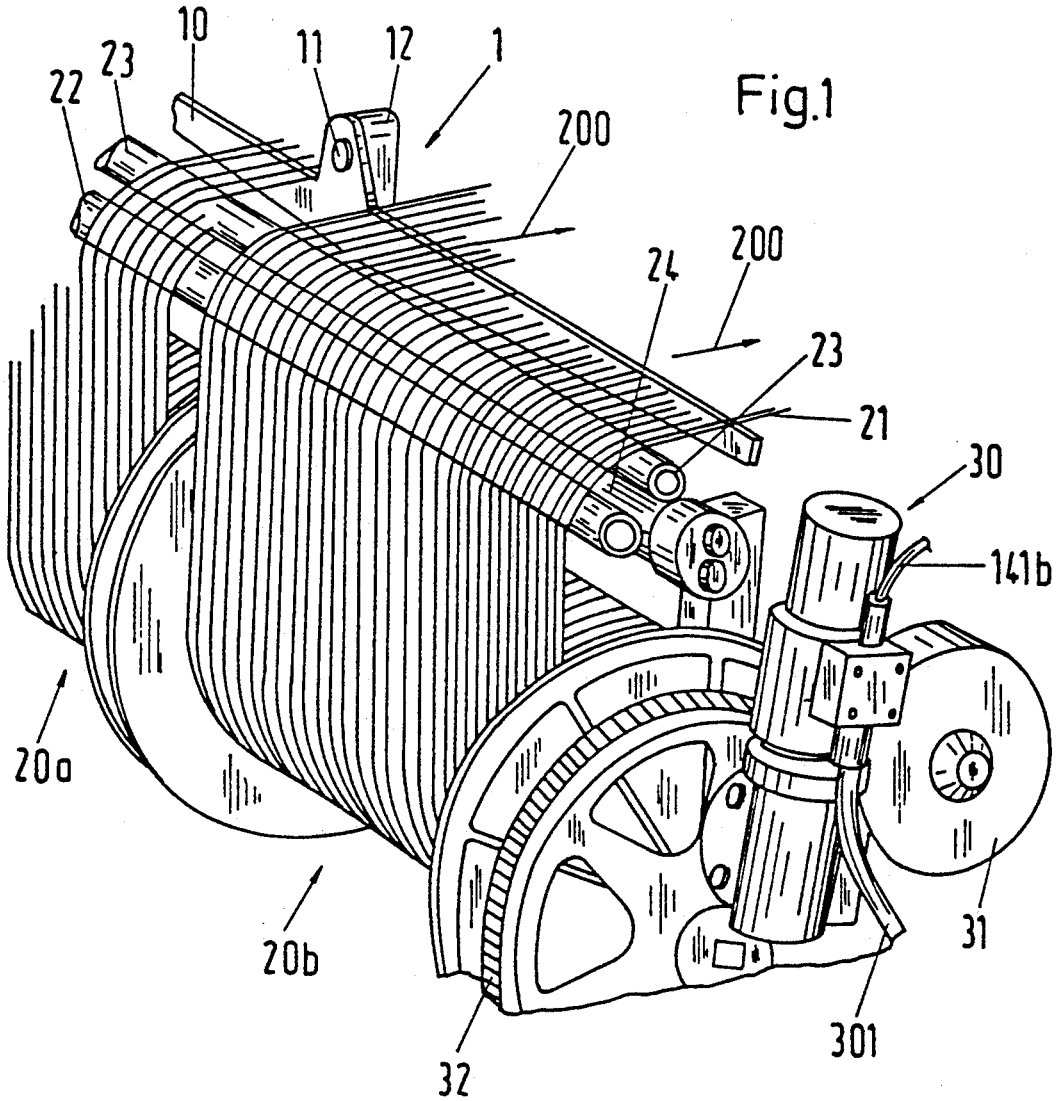
Fig.1
Fig.2
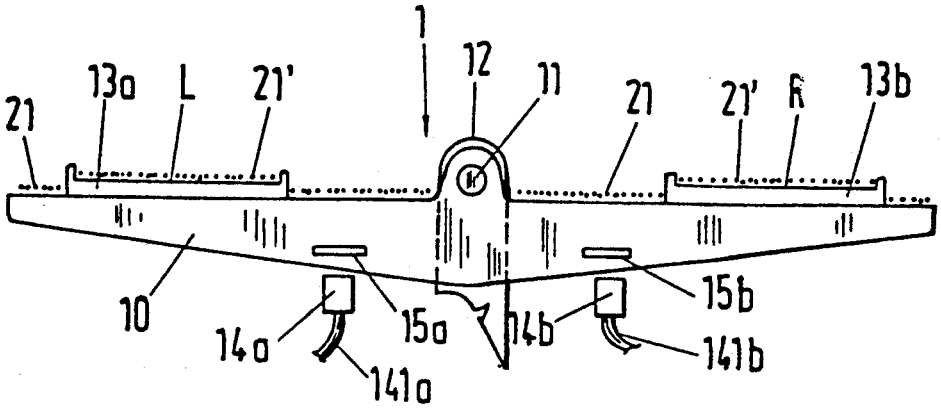

DRIVE ADJUSTMENT DEVICE FOR SECTIONAL WARP BEAM LET-OFF MOTION

BACKGROUND OF THE INVENTION

The invention relates to a weaving machine with control devices that rapidly correct the warp let-off speed of the individual sectional warp beams according to the differences in the warp tensions measured. A weaving machine of the type described is disclosed in. EP-PS 0 136 389. This reference describes a feeler member mounted between a fixed deflecting roll and the whip roll to measure the tension of a warp yarn sheet. The feeler member comprises a deflecting element and a leaf spring, which is fixed to the deflector roll. Because of the yarn forces, the deflecting element is deflected against the action of the leaf spring; this deflection is measured with a sensor.

This known weaving machine allows weaving from a plurality of sectional warp beams when there is a single continuous whip roll which remains parallel to the warp beam axis during pivoting. The warp let-off control device rests in other weaving machines on a special form of whip roll, in which a tension difference can be determined from an oblique position of the whip roll. The intermittent oblique position of the whip roll, however, causes a reduction in cloth quality.

In the case of the known feeler members with leaf springs there is another problem: it has been found in practice that in production engineering terms it is difficult for the spring constant of the leaf springs to remain within a sufficiently narrow tolerance range relative to the warp let-off control. Because of the wide divergence of the spring constant a special calibration must be performed for each feeler member. In terry looms with cloth control (see EP-A 0 350 446, FIG. 9), the forces acting on the feeler member at full beat-up and partial beat-up are very different. Here, therefore, the divergence of the spring constant proves particularly disadvantageous.

SUMMARY OF THE INVENTION

The present invention is directed to a weaving machine with a warp let-off control device in which the difference in the warp tension of sectional warp beams can be monitored simply and reliably. In contrast to prior art efforts it is not the difference between separately measured warp tensions that is determined in the weaving machine embodying the invention. On the contrary, the difference in the warp yarn forces acting on the feeler members is monitored directly. There is no need to make absolute tension measurements; calibrations of measuring devices are, therefore, unnecessary.

BRIEF DESCRIPTION OF THE FIGURES

The invention will now be described in more detail for various embodiments with reference to the drawings, in which:

FIG. 1 illustrates a detail of the warp beam area of a weaving machine embodying the invention;

FIG. 2 shows a first embodiment of the rocker-like bar for monitoring the warp tension difference;

DESCRIPTION OF THE PREFERRED EMBODIMENT

Figure 3:
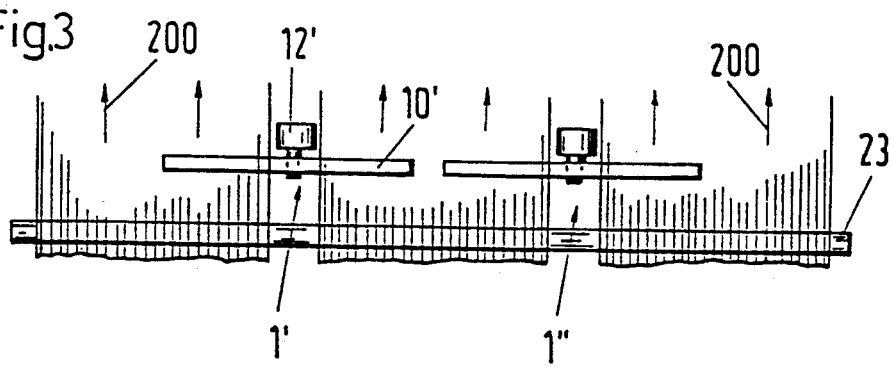
FIG. 3 is a plan view showing a detail of a weaving machine with three sectional warp beams.

FIG. 1 shows the device 1 with the rocker-like bar 10, the rocker bearing 11 and the upright 12; the half warp beams 20*a* and 20*b*; the warp yarns 21 (direction of advance 200); the spatially fixed deflecting roll 22; the whip roll 23; fixed to the carrier beam 24 which, connected to a torsion spring, is rotatably mounted (see EP-PS 0 109 472); the warp let-off motor 30 with the transmission 31 and the gearwheel drive 32 for the sectional warp beam 20*b*, the cables 301, 141*b* making connections from the motor 30 to a control box or sensor (not shown).

On the rocker-like bar 10, as FIG. 2 shows, feeler members 13*a*, 13*b* are symmetrically mounted. Each feeler member measures the tension of a warp yarn sheet, which comprises only a part (but for both feeler members an equal part) of the associated warp section. The feeler member could, of course, alternatively extend over the full width of the warp section and detect all warp yarns when measuring the tension. The rotational axis of the rocker bearing 11 is horizontal and is situated between the half warp beams 20*a*, 20*b*. The bar 10 may, as shown in FIG. 1, extend over the entire width of the half warp beams. It is intended that the feeler members 13*a*, 13*b* should be mounted on the bar however desired. Care should be taken, however, to mount them symmetrically relative to the rocker bearing 11.

Because the feeler members 13*a*, 13*b* are mounted as desired, it is possible to position them, for example, in the inner area of the warp sections, where there are no tension anomalies. Such tension anomalies may, for example, be caused by spreaders; alternatively, they may arise in the marginal zones of the warp beams during winding of these beams.

By means of fixed sensors 14*a*, 14*b* (connecting cables 141*a*, 141*b*), it is possible to detect deviations of the bar alignment from a horizontal reference position, and on the basis of this deviation it is possible to correct the warp let-off speed for the individual half warp beams. To monitor the beam alignment (an operation for which a single sensor 14*a* or 14*b* is sufficient), for example, the distance to a reference surface 15*a* (or 15*b*) on the bar is measured. The sensors (displacement transducers) may, for example, be capacitive sensors.

The feeler members 13*a*, 13*b* are preferably mounted below the warp yarns 21'; in principle, however, it would also be possible to monitor the warp tension from above. The feeler members 13*a*, 13*b* may comprise a deflecting roll for the warp yarns 21', or may comprise a deflecting strip. It is possible also to provide a notched surface for precise warp guiding on the feeler members 13*a*, 13*b*.

Since, when monitoring the warp tensions, it is sufficient to take only some of the warp yarns 21 for the measurement, it is possible even where there are three or more sectional warp beams to apply the method described above with the rocker-like bar 10, as in the case of double-track weaving. This is illustrated in FIG. 3: the devices 1' (bar 10', upright 12') and 1'' monitor the tension difference between mutually adjoining warp sections (direction of warp advance 200). In contrast to the situation with double-track weaving, the bars here can extend only barely into the center of the warp sections.

Figure 4:
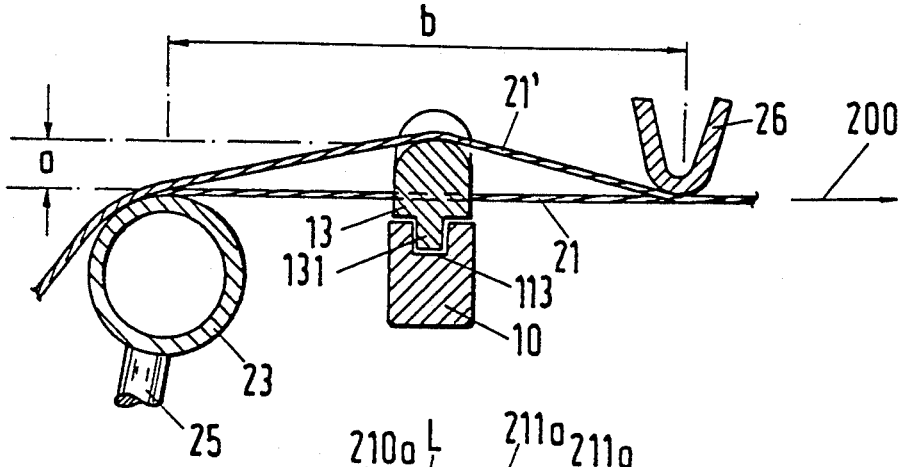
FIG. 4 represents a cross-section through a feeler member in the direction of warp advance.
Figure 5:
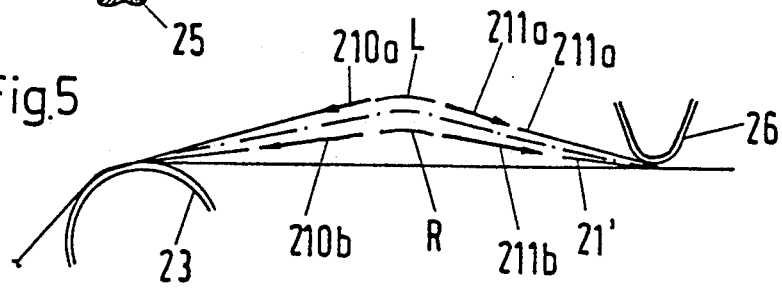
FIG. 5 illustrates the force conditions for the warp yarns at the feeler member in the event of unequal warp tensions.

The mode of operation of the rocker-like bar 10 will be described in more detail with reference to FIGS. 4 and 5. FIG. 4 shows a cross-section running through the points L or R (FIG. 2) on the feeler members 13*a*, 13*b* (here designated 13). The bar 10 is between the whip roll 23 and warp hold-down means 26, which is mounted behind the heald shafts (not shown). Connecting elements 25 attach the whip roll 23 to the carrier beam (not shown here, but designated 24 in FIG. 1). The feeler member 13 with the rib 131 is pushed into the groove 113 in the bar 10. By means of the feeler member 13 the tension of the warp yarns 21' is measured, while the warp yarns 21, which are not deflected out of the warp plane, do not contribute to the measurement. If the yarn forces diminish on the left sectional beam, the bar 10 turns clockwise (as seen in the direction 200 of warp advance): that is, the point L moves upwards, the point R correspondingly downwards. Another equilibrium position is established, which may for example be determined by the bar position shown in FIG. 5. In this equilibrium position, the resultants of the yarn forces 210*a* and 211*a* (point L) or 210*b* and 211*b* (point R) are equal. By reducing the warp let-off speed for the left sectional beam the yarn forces at the point L can be matched to those at the point R, so that the bar 10 returns to its horizontal reference position.

In the weaving machine embodying the invention, the warp yarns are only slightly disturbed by the feeler members 13*a*, 13*b*; for the deflection a of the warp yarns 21' from the warp plane (FIG. 4) need amount to only a few millimeters, at most 5 mm (the distance b between the whip roll 23 and hold-down means 26 being about 30 cm).

Figure 6:
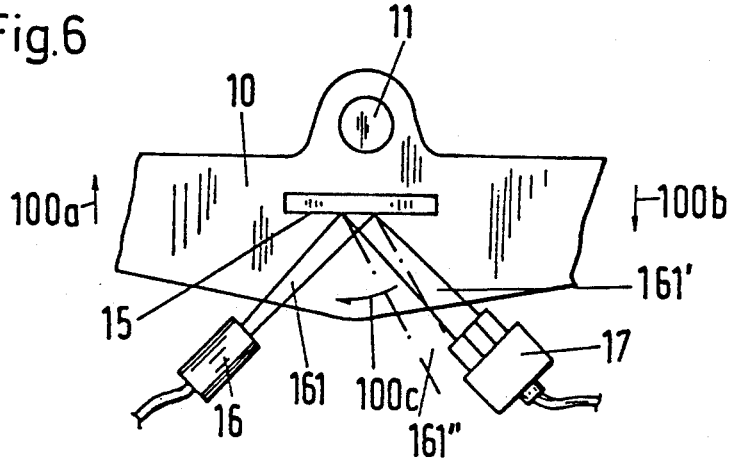
FIG. 6 shows a device for monitoring the inclination of the bar.

FIG. 6 shows how the bar alignment can be monitored by means of a fixed beam source 16, for example a source of light or ultrasound. By means of fixed sensors 17, which respond to the beam 161, 161', and a beam-reflecting surface 15 on the bar 10, it is possible to register changes in the angle of the surface 15. If the bar 10 turns as indicated by the arrows 100*a*, 100*b*, the reflected beam 161' is deflected as indicated by arrow 100*c*, so that the deflected beam 161'' is now detected only by some of the sensors 17 (which for example form a group of three parallel sensors). The signals generated by the sensors 17 can be used as a basis for regulating the warp tension.

Figure 7:
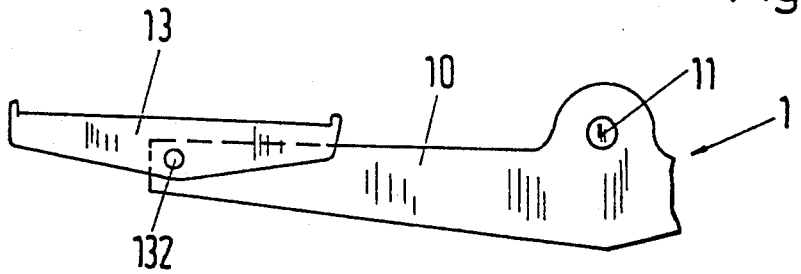
FIG. 7 illustrates a feeler member mounted like a rocker on the bar.

FIG. 7 shows a feeler member (13) which is designed to be rocker-like, like the bar 10. It has a central bearing (132) about which it can be tilted perpendicular to the direction of warp advance. Because of this rocker-like design, the feeler member (13) remains aligned parallel to the warp plane when the bar 10 tilts.

Figure 8:
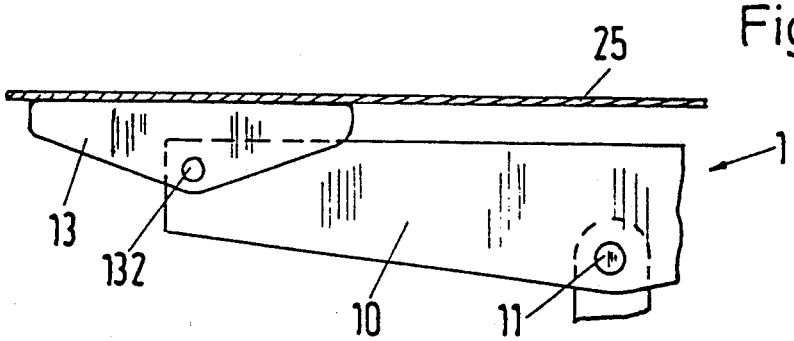
FIG. 8 shows a rocker-like bar mounted below the cloth at the fabric end.

EP-A 0 385 061 (Dornier) discloses a device for measuring warp tension which is situated after the crossing point in the region of the finished fabric. The weaving machine of the present invention could also be arranged with the device 1 at the fabric end. FIG. 8 shows a detail of such a device 1, reference numeral 25 designating the cloth between the fell and the breast beam.

Figure 9:
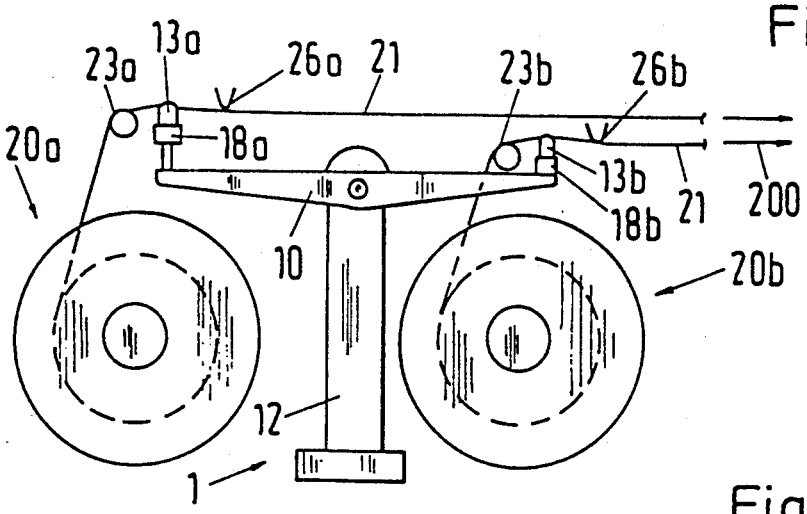
FIG. 9 is a side view of the warp beam area of a weaving machine embodying the invention with two sectional warp beams arranged one behind the other.
Figure 10:
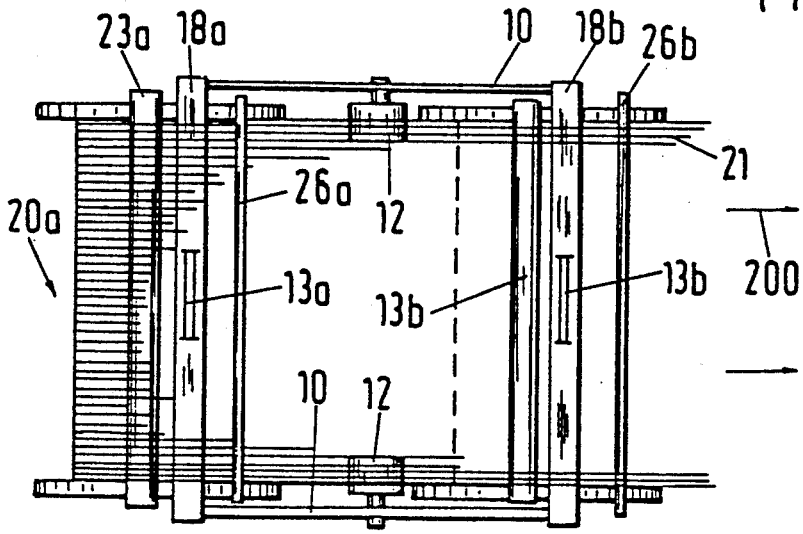
FIG. 10 is a plan view showing the same warp beam area as in FIG. 7.

FIGS. 9 and 10 illustrate an embodiment of the invention in which—as is the case in carpet weaving machines—the sectional warp beams 20*a*, 20*b* are arranged one behind the other. Here there is a device 1 with two rocker-like bars 10 (and two uprights 12), the bars 10 being aligned not perpendicular to the direction 200 of warp advance, but parallel to it. The feeler members 13*a*, 13*b* are mounted on cross-beams 18*a*, 18*b* connecting the ends of the bars 10, which are situated outside the warp. In this embodiment two separate whip rolls 23*a* and 32*b* and two separate warp hold-down means 26*a*, 26*b* are provided. By means of sensors (not shown in FIGS. 9 and 10) the inclination of the bars 10 is monitored as described above.

In the weaving machine with sectional warp beams 20*a*, 20*b* of which the axes are one beside the other (FIGS. 9, 10), it may be desirable for the two warp sections to have different tensions. This is simple to arrange, by applying different numbers of warp yarns 21' to the two feeler members 13*a*, 13*b* according to the tension difference desired. The monitoring of the warp tension can then be performed in the same way as described above.

I claim:

1. A weaving machine comprising:

at least two sectional warp beams for unwinding warp yarns through the weaving machine, the sectional warp beams being arranged parallel to each other with mutually adjacent axes;

at least two drives, each drive operatively coupled to one of the warp beams for rotating each warp beam at a speed of rotation;

a rocker bar pivotally mounted to an upright positioned between the warp beams, the rocker bar having two feeler members symmetrically mounted on either side of the upright for measuring the tension of the warp yarns, the rocker bar being parallel to a warp plane when the tension of the warp yarns from each warp beam is substantially equal;

a whip roll rotatably mounted to the weaving machine for directing the warp yarns onto the rocker bar; and a sensor for measuring a deviation of the rocker bar with respect to the warp plane, the sensor being adapted to send a signal to the drives corresponding to said deviation, the drives adjusting the speed of rotation of at least one of the warp beams so to correct the deviation of the rocker bar with respect to the warp plane.

2. A weaving machine as claimed in claim 1 wherein each feeler member is a deflecting strip.

3. A weaving machine as claimed in claim 1 wherein each feeler member is a deflecting roll.

4. A weaving machine comprising:

at least two sectional warp beams for unwinding warp yarns through the weaving machine;

at least two drives, each drive operatively coupled to one of the warp beams for rotating each warp beam at a speed of rotation;

a rocker bar pivotally mounted to an upright positioned between the warp beams, the rocker bar being under the tension of the warp yarns from both warp beams; and a sensor for measuring a deviation of the rocker bar with respect to a warp plane, the sensor being adapted to send a signal to the drives corresponding to said deviation, the drives adjusting the speed of rotation of at least one of the warp beams so to correct the deviation of the rocker bar with respect to the warp plane.

5. The machine of claim 4 further comprising first and second feeler members symmetrically mounted to the rocker bar on either side of the upright, the feeler members deflecting some of the warp yarns from each warp beam out of the warp plane so to increase the tension of the warp yarns on the rocker bar.

6. The machine of claim 5 wherein the feeler members are mounted near the upright, the feeler members contacting only some of the warp yarns of each warp beam.

7. The machine of claim 5 wherein the feeler members are arranged below the warp yarns.

8. The machine of claim 5 wherein the feeler members each have a central bearing, the feeler members being pivotally mounted to the central bearing in a plane perpendicular to the warp plane so that the feeler members will remain aligned with the warp plane when the rocker bar deviates from the warp plane.

9. The machine of claim 4 further comprising a whip roll bar and a deflecting roll bar rotatably mounted to the weaving machine for directing the warp yarns onto the rocker bar.

10. The machine of claim 4 wherein the sectional warp beams are arranged in a row with a common axis.

11. The machine of claim 4 wherein the sensor measures a distance to a reference surface on the rocker bar to determine the deviation of the rocker bar from the warp plane.

12. A weaving machine comprising:

at least two sectional warp beams for unwinding warp yarns through the weaving machine;

at least two drives, each drive operatively coupled to one of the warp beams for rotating each warp beam at a speed of rotation;

a rocker bar pivotally mounted to an upright position between the warp beams, the rocker bar having first and second feeler members symmetrically mounted on either side of the upright for measuring the tension of the warp yarns, the rocker bar being parallel to a warp plane when the tension of the warp yarns from each warp beam is substantially equal;

a whip roll rotatably mounted to the weaving machine for directing the warp yarns onto the rocker bar;

a sensor for measuring a deviation of the rocker bar with respect to the warp plane, the sensor being adapted to send a signal to the drives corresponding to said deviation, the drives adjusting the speed of rotation of the warp beams so to correct the deviation of the rocker bar with the warp plane; and the sensor including a beam source and a plurality of beam receivers, the beam source directing a beam against a reference surface on the rocker bar, the beam receivers receiving the beam after the beam has reflected off the reference surface, the sensor determining the deviation of the rocker bar based on an angle of the reference surface.

13. The machine of claim 12 further including warp hold down means mounted behind the rocker bar in the direction of warp advance, said means providing tension to the warp yarns as the warp yarns move over the rocker bar.

14. A device for measuring the speed of rotation of at least two warp beams in a weaving machine comprising:

a rocker bar pivotally mounted to an upright and being constructed so as to be under the tension of the warp yarns from both warp beams, the upright being positioned between the warp beams;

first and second feeler members symmetrically mounted to the rocker bar on either side of the upright, the feeler members deflecting some of the warp yarns from each warp beam out of the warp plane to increase the sensitivity of the rocker bar to changes in the tension of the warp yarns;

a sensor for measuring a deviation of the rocker bar with respect to a warp plane, said deviation corresponding to a difference in the speed of rotation of the warp beams.

* * * * *